US006945205B2

(12) United States Patent
Heintzen et al.

(10) Patent No.: US 6,945,205 B2
(45) Date of Patent: Sep. 20, 2005

(54) INTERNAL-COMBUSTION ENGINE WITH HYDRAULIC DEVICE FOR ROTATION ANGLE ADJUSTMENT OF A CAMSHAFT RELATIVE TO A CRANKSHAFT

(75) Inventors: Dirk Heintzen, Hagen (DE); Gregory Müller, Troy, MI (US); Roger Meyer, Brighton, MI (US)

(73) Assignee: INA-Schaeffler KG, Herzogenaurach (DE)

( * ) Notice: Subject to any disclaimer, the term of this patent is extended or adjusted under 35 U.S.C. 154(b) by 0 days.

(21) Appl. No.: 10/910,969

(22) Filed: Aug. 4, 2004

(65) Prior Publication Data

US 2005/0034693 A1 Feb. 17, 2005

Related U.S. Application Data

(60) Provisional application No. 60/495,421, filed on Aug. 15, 2003.

(51) Int. Cl.[7] ..... F01L 1/34

(52) U.S. Cl. ..... 123/90.17; 123/90.15; 123/90.31

(58) Field of Search ..... 123/90.15, 90.16, 123/90.17, 90.18, 90.27, 90.31; 464/1, 2, 160

(56) References Cited

U.S. PATENT DOCUMENTS 5,058,539 A * 10/1991 Saito et al. ..... 123/90.17

6,675,752 B1 * 1/2004 Kunne et al. ..... 123/90.17

FOREIGN PATENT DOCUMENTS

JP 09209723 A * 8/1997 ..... F01L/1/34

* cited by examiner

*Primary Examiner*—Thomas Denion
*Assistant Examiner*—Ching Chang
(74) *Attorney, Agent, or Firm*—Volpe and Koenig, P.C.

(57) ABSTRACT

An internal-combustion engine with a hydraulic device (1) for rotation angle adjustment of a camshaft (2) relative to a crankshaft is provided and includes a rotor with an impeller form (7), which is rotationally fixed via a central fastener (6) to the camshaft, and a stator (4), which rotates synchronously with a drive wheel (3) driven by the crankshaft, wherein on both sides of the impeller blades of the rotor, there are pressure chambers, which are each limited by radial walls of the stator (4) and can be filled with and emptied of hydraulic fluid via a hydraulic system, wherein the hydraulic fluid is guided, on one hand, via an annular gap (13) between rotor (7) and the central fastener (6) and, on the other hand, through generally axial and radial channels into the pressure chambers. Through the use of a rotor (7) with a groove (10) running in the circumferential direction and a ring shaped intermediate element (9) adapted to the device, the internal-combustion engine can be equipped with a device (1) for adjusting the rotation angle, for which the number and/or arrangement of the axial channels for supplying hydraulic fluid do not agree with those of the camshaft of the internal-combustion engine. This construction enables the use of the device (1) on many different internal-combustion engines, without expensive adaptations of the device (1).

8 Claims, 5 Drawing Sheets

INTERNAL-COMBUSTION ENGINE WITH HYDRAULIC DEVICE FOR ROTATION ANGLE ADJUSTMENT OF A CAMSHAFT RELATIVE TO A CRANKSHAFT

This application claims benefit of No. 60,495,421 filed Aug. 15, 2003.

FIELD OF THE INVENTION

The invention relates to an internal-combustion engine with a hydraulic device for rotation angle adjustment of a camshaft relative to a crankshaft, including a rotor with an impeller form, which is rotationally fixed to the camshaft by means of a central fastener, and a stator, which rotates synchronously with a drive wheel driven by the crankshaft, wherein, on both sides of the impeller blades of the rotor, there are pressure chambers, which are each limited by radial walls of the stator and which can be filled with and emptied of hydraulic fluid by means of a hydraulic system. The hydraulic fluid is guided, on one hand, via an annular gap between the rotor and central fastener, and on the other hand, through channels running essentially in the axial direction in its hub and through radial channels into the pressure chambers.

BACKGROUND

From DE 100 49 494 A1, an internal-combustion engine with a generic hydraulic device for adjusting the rotation angle of a camshaft is known, which can change the phase position of a camshaft relative to a crankshaft. This device consists of a rotor and a stator, of which the first, formed as an impeller, surrounds the camshaft, to which it is mounted with an axial central fastener and rotates synchronously with it. The stator is sealed by two axial side walls so that it is sealed tight against a pressurized medium, surrounds the rotor and rotates synchronously with a drive wheel driven by the crankshaft. Radial walls in the stator permit only a limited rotation angle of the rotor and form with the rotor several pressure chambers, which can be filled with hydraulic fluid. The hydraulic fluid, which is from the lubricating oil circuit of the internal-combustion engine, is guided via first and second radial bore holes or via first and second axial channels of the camshaft into first and second bore holes or first and second channels of the rotor and from there into the pressure chambers.

However, one disadvantage for this known device is that the axial bore holes in the camshaft must agree in number, position, and shape with those of the rotor in order for the device to be able to adjust this camshaft. For any application to a different type of internal-combustion engine, for which this agreement is not the case, these prerequisites must be fulfilled, i.e., either a modified camshaft or a device adapted to the camshaft for adjusting the rotation angle must be used. This increases the production costs, in particular, the production of special sintered parts can become necessary.

SUMMARY

Therefore, the invention is based on the objective of designing an internal-combustion engine with a hydraulic device for adjusting the rotation angle of a camshaft relative to a crankshaft, such that the device can be mounted on its camshaft with simple means without additional modification expense, even if the axial bore holes of the rotor and the camshaft do not agree in shape, number, and arrangement.

According to the invention, the objective is solved by a hydraulic device for rotation angle adjustment of a camshaft relative to a crankshaft of an internal-combustion engine having a rotor with an impeller form, which is rotationally fixed via an axial central fastener to the camshaft, a stator, which rotates synchronously with a drive wheel driven by the crankshaft, and on both sides of the impeller blades of the rotor, there are pressure chambers, which are each limited by radial walls of the stator and which can be filled with and emptied of hydraulic fluid by means of a hydraulic system, wherein the hydraulic fluid is guided, on one hand, via an annular gap between the rotor and the central fastener and, on the other hand, by essentially axial channels and radial channels into the pressure chambers, such that the first, axial channels formed as coaxial bore holes in the camshaft open into a groove of the rotor running in the circumferential direction and are guided by the radial bore holes, which are adapted in number, shape, and arrangement to the rotor formed as an impeller, outwards into first pressure chambers. In addition, the rotor has radial through holes, which do not intersect the groove and which are adapted on their side in number, shape, and arrangement to the rotor, for supplying the second pressure chambers, which are complementary to the first pressure chambers, with hydraulic fluid from the second channels of the camshaft. The rotor has a direct connection to the end of the camshaft, so that an external sealing effect is realized.

If the second channels of the camshaft are formed such that they allow the hydraulic fluid to flow directly around the axial central fastener, it is guaranteed by the configuration of the rotor with the groove that the hydraulic fluid is guided from the axial, first, and second channels of the camshaft into first and second, radial bore holes of the rotor, which lie in two different sectional planes, and thus the first and second pressure chambers can be charged separately with hydraulic fluid.

If fluid does not flow directly around the central fastener through the second channels within the camshaft, this type of flow can still be realized if a ring-shaped intermediate element is inserted into a recess, which is then necessary and which is adapted to the dimensions of the intermediate element, in the rotor on the end. The groove of the rotor is then covered by the intermediate element.

The intermediate element has axially extending through recesses, which agree with the first axial channels of the camshaft in number and arrangement, so that the hydraulic fluid can be guided out of the first axial channels of the camshaft through the intermediate element into the annular groove and from there through the radial bore holes into the first pressure chambers. In addition, the intermediate element has radially extending recesses, such that they can receive the hydraulic fluid from the second, axial channels of the camshaft and guide it to the inner opening of the intermediate element, so that it flows around the axial central fastener of the device and can be led via the radial through holes of the rotor into the second pressure chambers.

Furthermore, the intermediate element has a bore hole for receiving an element for radial orientation, which guarantees both the alignment of the intermediate element to the rotor and also the alignment of the entire hydraulic device for the rotation angle adjustment relative to the camshaft. It is especially advantageous to form the element for radial orientation as an axial alignment pin of the rotor.

Another feature of the rotor is that its annular groove preferably has a width, which is as large as possible, which is greater than the groove depth, and which is greater than a diameter of the axial recesses of the intermediate element. This guarantees that all of the first axial channels emerging from the end of the camshaft open into the annular groove of the rotor independent of their arrangement and number. However, it has proven effective that the amount of flow of hydraulic fluid for fault-free operation is then also sufficient if the annular groove and the axial recesses only partially overlap.

The hydraulic device formed according to the invention for rotation angle adjustment of a camshaft relative to a crankshaft for an internal-combustion engine thus has the advantage, relative to the devices known from the state of the art, that it can be equipped through the use of the rotor with the annular groove and, if necessary, a simple intermediate element adapted to the device with a device for adjusting the rotation angle, for which the number and/or arrangement of the axial channels for supplying hydraulic fluid does not agree with those of the camshaft of the internal-combustion engine. Through the intermediate element, which is economical to produce, the device can be used in many different internal-combustion engines without requiring expensive adaptations of the device.

BRIEF DESCRIPTION OF THE DRAWINGS

The invention is described in more detail in the following with reference to an embodiment and is shown schematically in the associated drawings.

In the drawings.

DETAILED DESCRIPTION OF THE DRAWINGS

Figure 1:
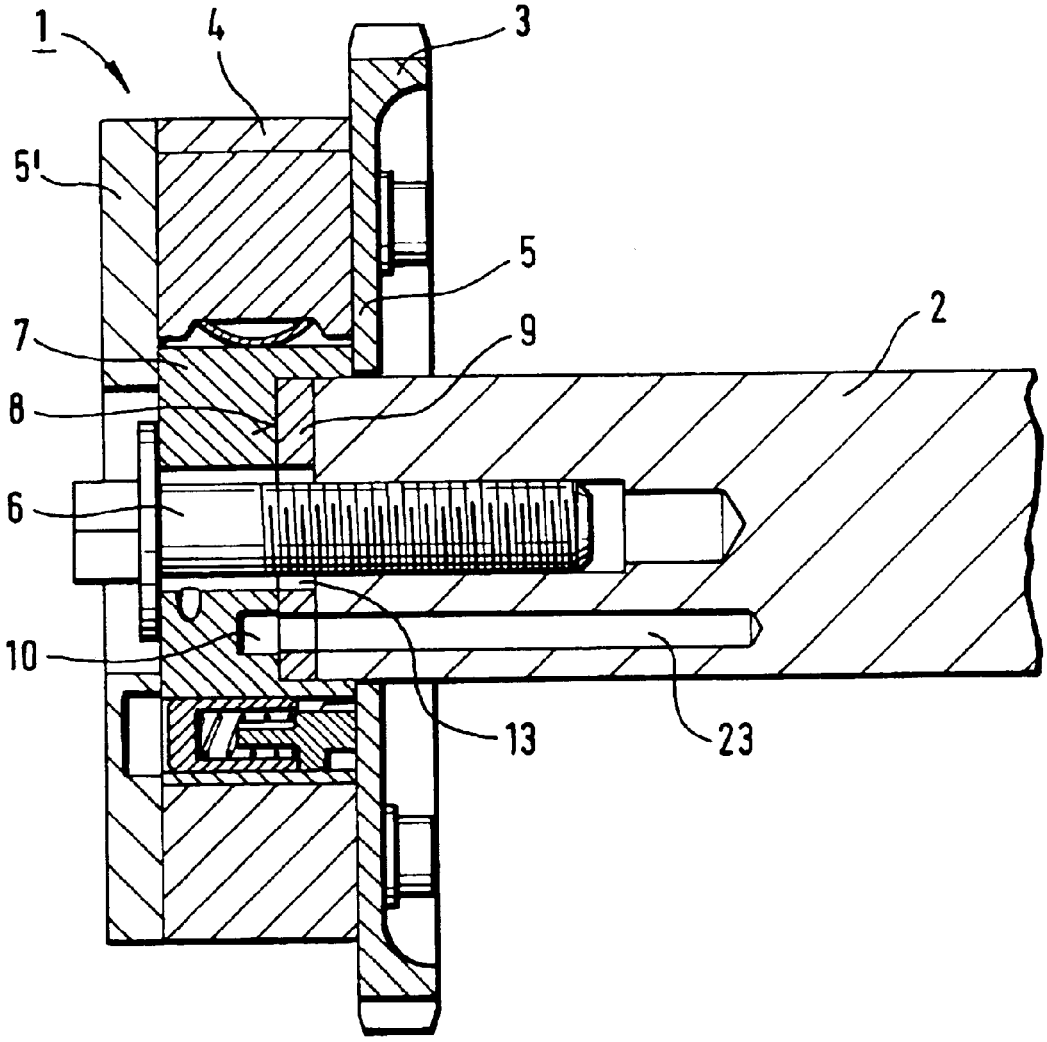
FIG. 1 is a longitudinal section view of the device for adjusting the rotation angle.

FIG. 1 shows the essential parts of a hydraulic device 1 for adjusting the rotation angle of a camshaft 2 relative to a crankshaft (not shown), which is formed as a hydraulic actuating drive. This device 1 is driven by a drive wheel 3, which is connected to the crankshaft, e.g., by a chain that is not shown in more detail. The device 1 essentially comprises a stator 4, which is connected rigidly to the drive wheel 3 and which is sealed tight against a pressurized medium by axial side walls 5, 5', and a rotor 7 rotationally fixed to the camshaft 2 by an axial central fastener 6, wherein the rotor 7 is formed as an impeller. The axial central fastener 6 forms an annular gap 13 with an intermediate element 9 inserted into a circular recess 8 (FIG. 2).

Figure 2:
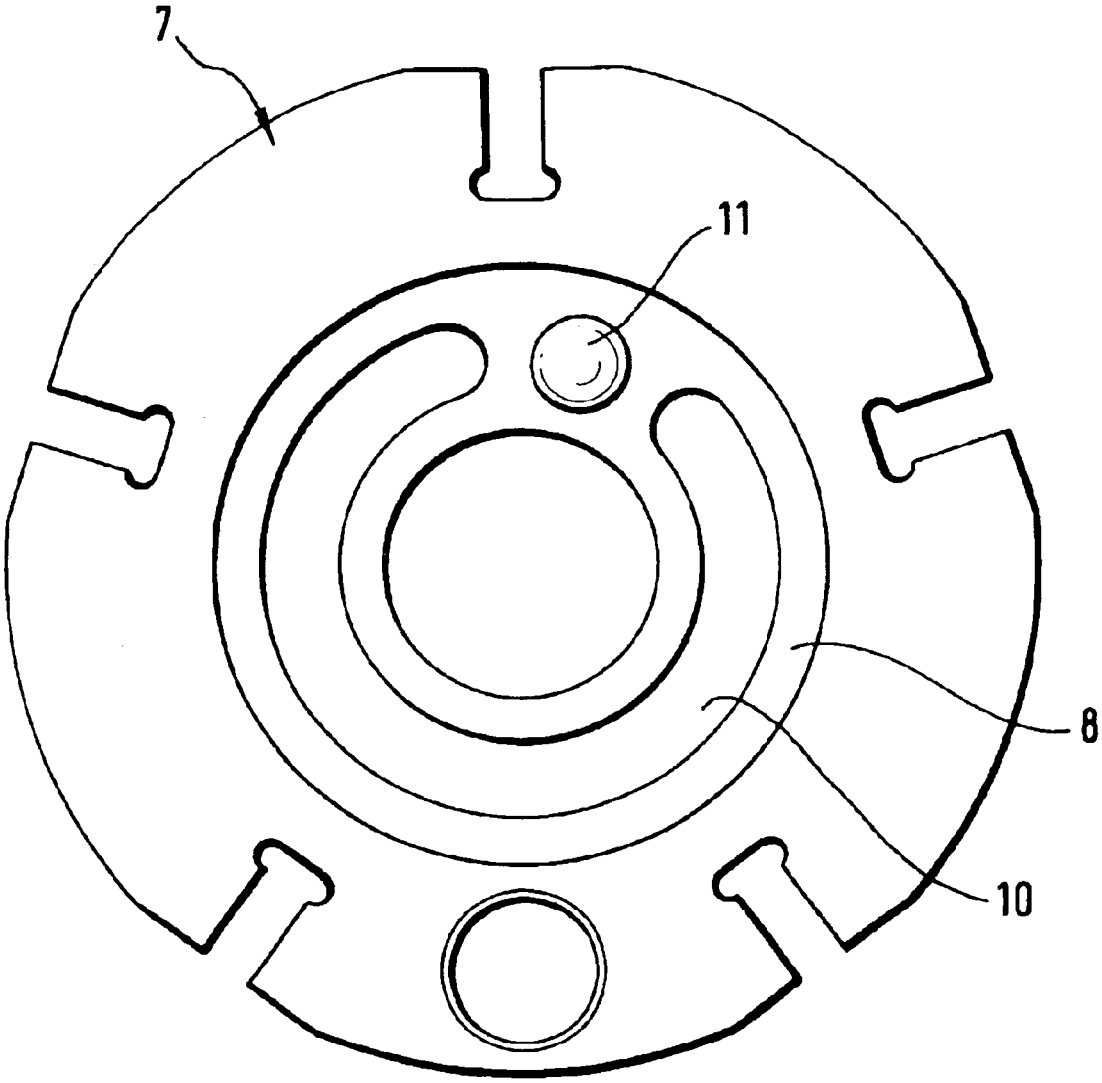
FIG. 2 is a camshaft-side view of an enlarged representation of the rotor without inserted impeller blades.

FIG. 2 shows that the rotor 7 (shown without impeller blades) contains the circular recess 8, into which an annular intermediate element 9 (FIG. 6*a*) can be inserted. In the circular recess 8, a groove 10 runs in the circumferential direction for receiving hydraulic fluid, which has a horseshoe shape and is formed with a rectangular cross-sectional profile. Because the groove 10 is supplied with hydraulic fluid from a first, axial channel of the camshaft 23 (FIG. 1) via the intermediate element 9, the groove 10 should be as wide as possible in order to be able to permit the use of a large variety of different intermediate elements 9. In addition, an element 11 for orientation in the circumferential direction can be recognized, which guarantees both the alignment of the intermediate element 9 through its receiving recess 12 (FIG. 6*a*) to the rotor 4 and also the alignment of the entire hydraulic device 1 for adjusting the rotation angle relative to the camshaft 2. A not-shown recess for receiving the element 11 for orientation in the circumferential direction is used in the camshaft 2. The element 11 for orientation in the circumferential direction is advantageously formed as an alignment pin. Thus, there is a positive-fit connection, which prevents, in particular, relative rotation.

Figure 3:
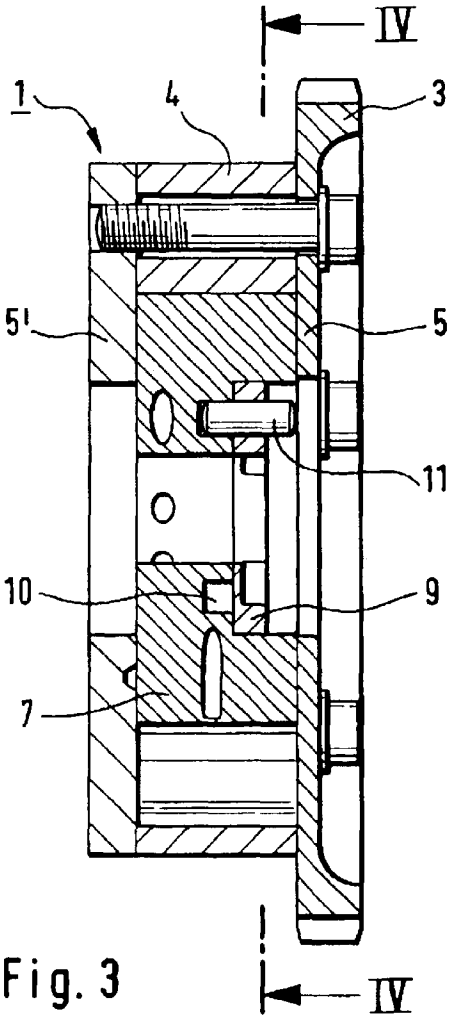
FIG. 3 is a second longitudinal section of the device for adjusting the rotation angle, offset in the circumferential direction relative to FIG. 1.

FIG. 3 shows a second longitudinal section of the device 1, offset in the circumferential direction relative to FIG. 1, from which the spatial position of the element 11 for orientation in the circumferential direction is made clear once again.

Figure 4:
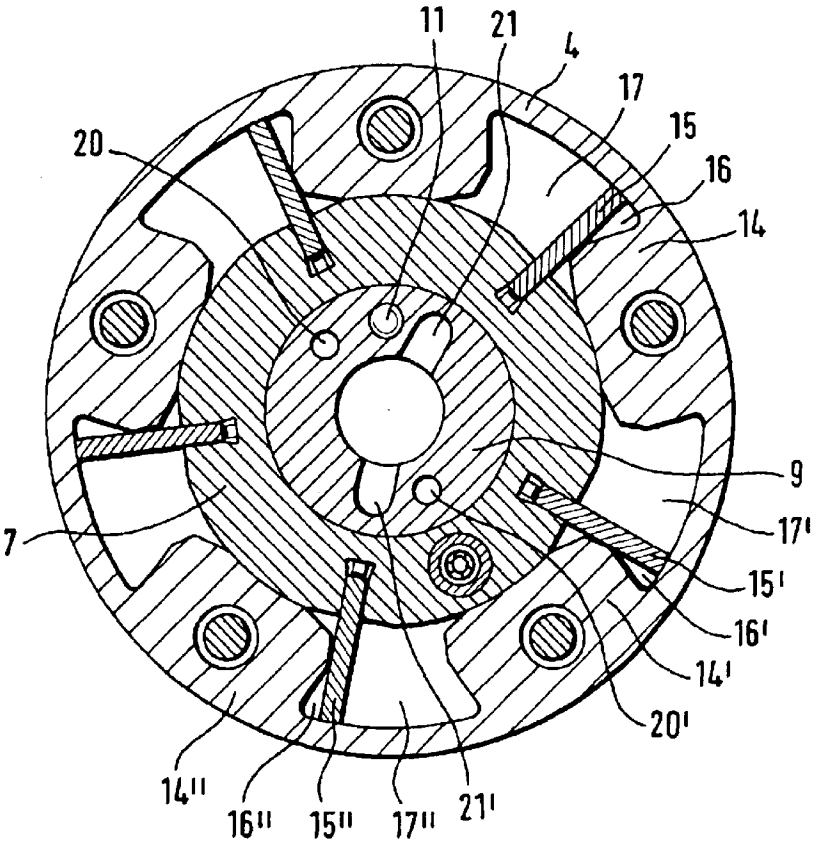
FIG. 4 is a cross section of the device for adjusting the rotation angle along the section line IV—IV in FIG. 3 in the viewing direction towards its camshaft-side end.

FIG. 4 shows a cross section of the device 1 for adjusting the rotation angle along the section line IV—IV in FIG. 3. It can be seen that the stator 4 of the device 1 through walls 14, 14', 14" running in the radial direction in the stator with the rotor 7 and its impeller blades 15, 15', 15" forms first 16, 16', 16" and second pressure chambers 17, 17', 17", which are complementary to the first pressure chambers and which, when filled with hydraulic fluid, produce a force-transfer connection between the rotor 7 and the stator 4.

Figure 5B:
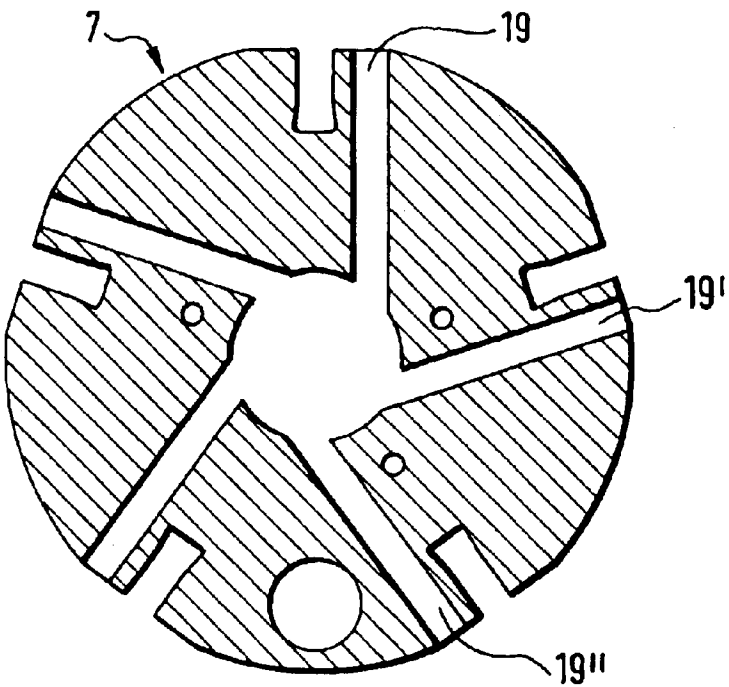
FIG. 5*b* is a cross section through the rotor in a plane, in which second, radial channels lie.
Figure 5A:
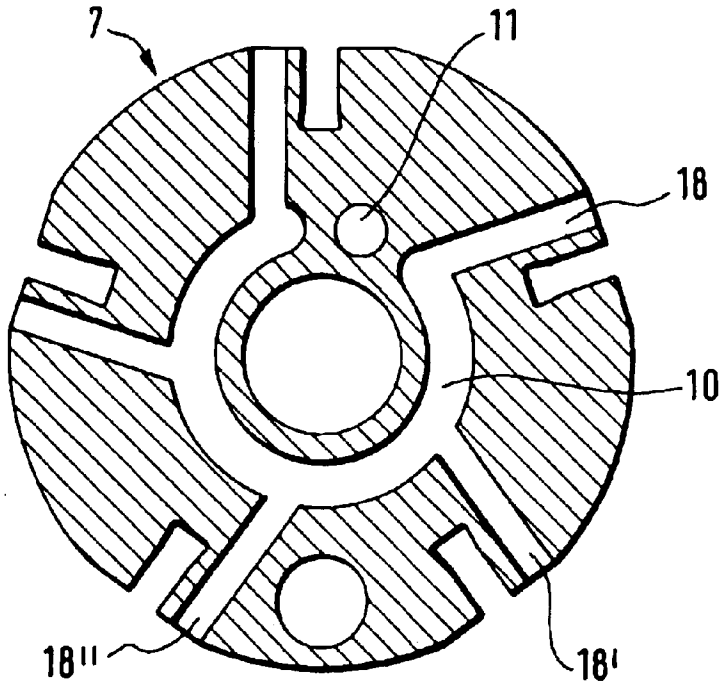
FIG. 5*a* is a cross section through the rotor in a plane, in which first, radial channels emerge from a groove.

From FIG. 5*a*, it can be seen that first, radial channels 18, 18', 18" lead to the first pressure chambers 16, 16', 16" from the annular groove 10. The hydraulic fluid can thus lead from the groove 11 into the first pressure chambers 16, 16', 16". In FIG. 5*b*, it can be seen that in a different plane there are second, radial channels 19, 19', 19", which lead hydraulic fluid from the region around the axial central fastener 6 into the second pressure chambers 17, 17', 17".

Figure 6B:
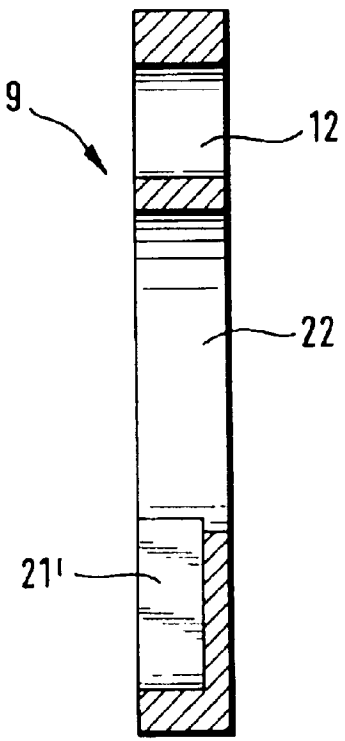
FIG. 6*b* is a longitudinal section through the intermediate element along the section line VIb—VIb in FIG. 6*a*.
Figure 6A:
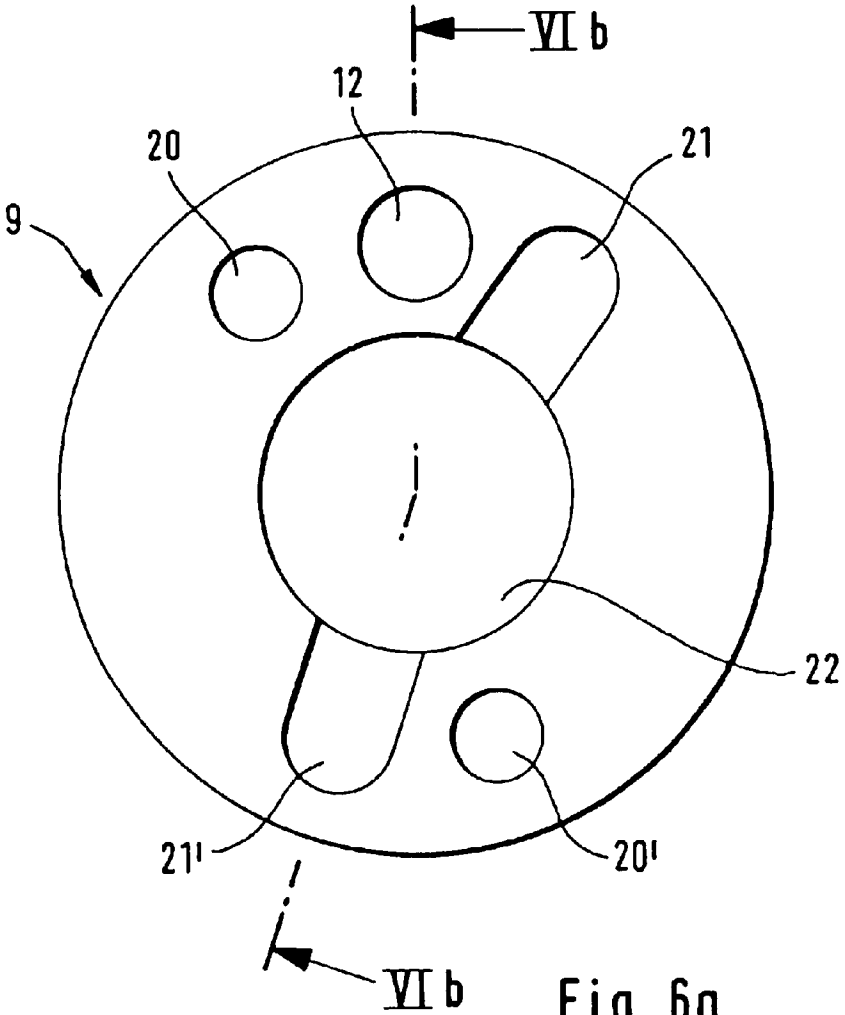
FIG. 6*a* is a top view of an enlarged detail representation of an intermediate element.

The setup of the intermediate element 9, which is spatially fixed by the receiving recess 12 for receiving the element 11 for radial orientation, can be seen from the FIGS. 6*a* and 6*b*. The intermediate element 9 creates the connection of the first, radial channels 18, 18', 18" and second, radial channels 19, 19', 19" of the hydraulic device 1 for adjusting the rotation angle with the first and second channels of the camshaft, such that the first, axial channels 23 of the camshaft meet axial recesses 20, 20', which are formed such that they guide the hydraulic fluid into the groove 10 and thus into the first pressure chambers 16, 16', 16". Advantageously, for the most part they agree in number, shape, and size with the axial channels 23 of the camshaft. The second axial channels of the camshaft (not shown) meet radial recesses 21, 21' of the intermediate element 9 such that they guide the hydraulic fluid to the inner opening 22 of the intermediate element, such that the hydraulic fluid flows around the axial central fastener 6 and thus can be led via the second, radial channels 19, 19', 19" into the second pressure chambers 17, 17', 17".

The shown device 1 with the groove 11 running in the circumferential direction has proven to be especially advantageous, because the structural form of the entire device 1, possibly in connection with the intermediate element 9, can be realized independent of the channels of the camshaft supplying the hydraulic fluid. Instead of producing an adapted device for each camshaft 2, it is sufficient to adapt the intermediate element 9 to be produced economically to the structural shape of the camshaft 2. If the hydraulic fluid in the camshaft 2 is already guided into the region around the axial central fastener 6, the intermediate element 9 and the circular recess 8 can also be eliminated.

| List of reference symbols | |
|---|---|
| 1 | Internal-combustion engine with a hydraulic device for rotation angle adjustment of a camshaft relative to a crankshaft |
| 2 | Camshaft |
| 3 | Drive wheel |
| 4 | Stator |
| 5, 5' | Axial side walls |
| 6 | Axial central fastener |
| 7 | Rotor in impeller form |
| 8 | Circular recess |
| 9 | Annular intermediate element |
| 10 | Groove running in circumferential direction |
| 11 | Element for radial orientation |
| 12 | Receiving recess |
| 13 | Annular gap |
| 14, 14', 14" | Radial walls |
| 15, 15', 15" | Impeller blade |
| 16, 16', 16" | First pressure chambers |
| 17, 17', 17" | Second pressure chambers |
| 18, 18', 18" | First radial channels |
| 19, 19', 19" | Second radial channels |
| 20, 20' | Axial recesses |
| 21, 21' | Radial recesses of the intermediate element |
| 22 | Inner opening of the intermediate element |
| 23 | First, axial channel of the camshaft |

What is claimed is:

1. Internal-combustion engine with a hydraulic device (1) for adjusting the rotation angle of a camshaft (2) relative to a crankshaft, comprising:

a rotor (7) with an impeller form, which is rotationally fixed via an axial central screw (6) to the camshaft (2), a stator (4), which rotates synchronously with a drive wheel (3) driven by the crankshaft, wherein on both sides of impeller blades (15, 15', 15") located on the rotor, there are pressure chambers (16, 16', 16", 17, 17', 17"), which are each limited by radial walls (14, 14', 14") of the stator (4) and which can be filled with and emptied of hydraulic fluid by a hydraulic system, wherein the hydraulic fluid is guided, on one hand, via an annular gap (13) between the rotor (7) and central screw (6) and, on the other hand, by generally axially extending channels and radial channels into the pressure chambers (16, 16', 16", 17, 17', 17"), wherein the rotor (7) has a groove (10) extending in a circumferential direction from a camshaft-side end thereof, in which at least one first, axial channel (23) of the cramshaft (2) opens, and first, radial channels (18, 18', 18") emerge from the groove (10).

2. Device according to claim 1, wherein the rotor (7) includes an annular recess (8) on one end for receiving an intermediate element (9), wherein the groove (10) running in the circumferential direction is arranged in the circular recess (8).

3. Device according to claim 2, wherein the intermediate element (9) has a ring shape, adapted to dimensions of the recess (8), and provided with axial recesses (20, 20') and/or radial recesses (21, 21'), wherein the radial recesses open outwardly from an inner opening (22).

4. Device according to claim 3, wherein the axial recesses (20, 20') are formed as through holes.

5. Device according to claim 3, wherein the intermediate element (9) has a receiving recess (12) for an element (11) for orientation in the circumferential direction relative to the camshaft (2) and the rotor (7).

6. Device according to claim 5, wherein the element (11) for orientation in the circumferential direction is formed as an axial alignment pin.

7. Device according to claim 6, wherein the groove (10) is horseshoe-shaped and ends at a distance to the element (11) for orientation in the circumferential direction.

8. Device according to claim 3, wherein the radial recesses (21, 21') of the intermediate element (9), which guide the hydraulic fluid into the inner opening (22) of the intermediate opening (9), are sealed in the axial direction by the intermediate element (9) and an end of the camshaft (2).

* * * * *